United States Patent [19]

Lammers et al.

[11] 4,202,542

[45] May 13, 1980

[54] APPARATUS FOR HANDLING FLEXIBLE SHEET MATERIAL OF DIFFERENT SIZES

[75] Inventors: Gerald B. Lammers; Robert T. Ritchie, both of Boulder, Colo.

[73] Assignee: International Business Machines Corporation, Armonk, N.Y.

[21] Appl. No.: 856,552

[22] Filed: Dec. 1, 1977

[51] Int. Cl.[2] ..... B65H 5/12

[52] U.S. Cl. ..... 271/276; 271/96; 271/195; 271/196

[58] Field of Search ..... 271/276, 196, 195, 94, 271/95, 96, 108, 194, 275; 226/95

[56] References Cited

U.S. PATENT DOCUMENTS

| | | | |
|---|---|---|---|
| 3,005,565 | 10/1961 | Doane et al. | 271/96 X |
| 3,069,025 | 12/1962 | Winkler et al. | 271/96 |
| 3,341,195 | 9/1967 | Brandt et al. | 271/276 |
| 3,533,618 | 10/1970 | Carstens | 271/276 |
| 3,547,535 | 12/1970 | McLean et al. | 271/276 X |
| 4,056,057 | 11/1977 | Smith | 271/276 X |
| 4,145,040 | 3/1979 | Huber | 271/276 |

FOREIGN PATENT DOCUMENTS

| | | | |
|---|---|---|---|
| 651202 | 10/1962 | Canada . | |
| 579116 | 6/1933 | Fed. Rep. of Germany | 271/94 |
| 2644232 | 4/1977 | Fed. Rep. of Germany | 271/276 |

*Primary Examiner*—Bruce H. Stoner, Jr.
*Attorney, Agent, or Firm*—Frank C. Leach, Jr.

[57] ABSTRACT

A low inertia rotary drum supports sheets of paper of different sizes for transport and processing. The drum has a plurality of leading edge ports formed in its surface along the length of the drum. A vacuum is selectively applied to one or more of the ports in accordance with the dimension of the paper in the direction of the length of the drum. The drum has a plurality of sets of trailing edge ports formed in its surface with each of the sets being disposed a predetermined arcuate distance from the set of leading edge ports in accordance with the other dimension of the paper. Each set of trailing edge ports has the ports arranged longitudinally along the drum and parallel to the set of leading edge ports. Only one set of trailing edge ports extends for the same length as the set of the leading edge ports. One of the sets of the trailing edge ports has a vacuum applied thereto with the same number of ports of the trailing edge set having the vacuum applied thereto as the number of the leading edge ports.

22 Claims, 15 Drawing Figures

APPARATUS FOR HANDLING FLEXIBLE SHEET MATERIAL OF DIFFERENT SIZES

In the copending patent application of E. C. Korte for "Sheet Feed And Transport," Ser. No. 766,403, filed Feb. 7, 1977, now abandoned, and assigned to the same assignee as the assignee of this application, there is shown a low inertia rotary drum for transport of flexible sheets such as paper, for example. The drum has two longitudinal slots formed therein with each having spaced ports extending therethrough. The ports in one of the slots enables a vacuum to be applied to the leading edge of a sheet of paper while the ports in the other of the slots enables a vacuum to be applied to the trailing edge of the paper.

Thus, the drum of the aforesaid Korte application has the longitudinal slots arranged for a specific size of paper in both dimensions. If a different size of paper is desired, then a separate drum would have to be provided or the drum of the aforesaid Korte application would have to be substantially modified to be utilized with different sizes of paper. This would require a separate pair of solenoid valves for each size of paper, separate rotating seals for each size of paper, and separate baffles within the drum to prevent loss of vacuum through the ports left open by the smaller sizes of paper. This would be a very difficult system to implement.

The present invention is an improvement of the drum of the aforesaid Korte application in that the drum of the apparatus of the present invention can handle various sizes of flexible sheet material. Therefore, the apparatus of the present invention enables the use of different sizes of flexible sheet material such as paper, for example, to be supported and transported by the structure of the aforesaid Korte application.

The present invention accomplishes the foregoing by applying a vacuum to the leading edge of the paper for only substantially the dimension of the paper along the length of the drum. A second vacuum is applied along the trailing edge of the paper for substantially the dimension of the paper along the length of the cylinder. The second vacuum is applied adjacent the trailing edge of the paper through selectively controlling the portion of the surface of the drum to which the vacuum is applied.

The drum of the present invention has a plurality of sets of longitudinally spaced ports formed therein and spaced arcuately from each other about the drum with one set enabling a vacuum to be applied to the leading edge of the paper while only one of the other sets of the ports applies a vacuum to the trailing edge of the paper in accordance with the dimension of the paper in the circumferential direction around the drum. The apparatus of the present invention also controls how many of the ports of these two sets of ports apply a vacuum in accordance with the dimension of the paper along the length of the drum.

By permitting a vacuum to be applied only for substantially the dimension of the paper along the length of the drum, the vacuum is conserved since there is no sucking of air into the chamber through open ports. Therefore, the apparatus of the present invention does not require any increase in vacuum for different dimensions of the paper since only the ports over which the paper lies are subjected to a vacuum. The other ports are blocked from receiving the vacuum.

The application of the vacuum for substantially the dimension of the paper along the length of the drum insures that the paper is held against the drum in this direction. Similarly, by selecting the other set of ports to apply a vacuum to the trailing edge of the paper in accordance with the dimension of the paper in the circumferential direction around the drum, the trailing edge of the paper is retained against the drum.

The present invention accomplishes this application of a vacuum to the leading and trailing edges of a sheet of paper in accordance with the dimensions of the sheet of paper through the use of valves, which are preferably rotary valves, controlling the communication of each of the ports with vacuum sources. The valves are controlled by single control means so that activation of the single control means positions all of the valves at the desired position for the specific dimensions of the sheet of paper being handled by the drum.

An object of this invention is to provide an apparatus for handling flexible sheet material of various sizes.

Another object of this invention is to provide a drum for supporting flexible sheet material of various sizes thereon by vacuum.

A further object of this invention is to transport flexible sheet material of various sizes.

The foregoing and other objects, features, and advantages of the invention will be apparent from the following more particular description of a preferred embodiment of the invention as illustrated in the accompanying drawings.

Figure 1:
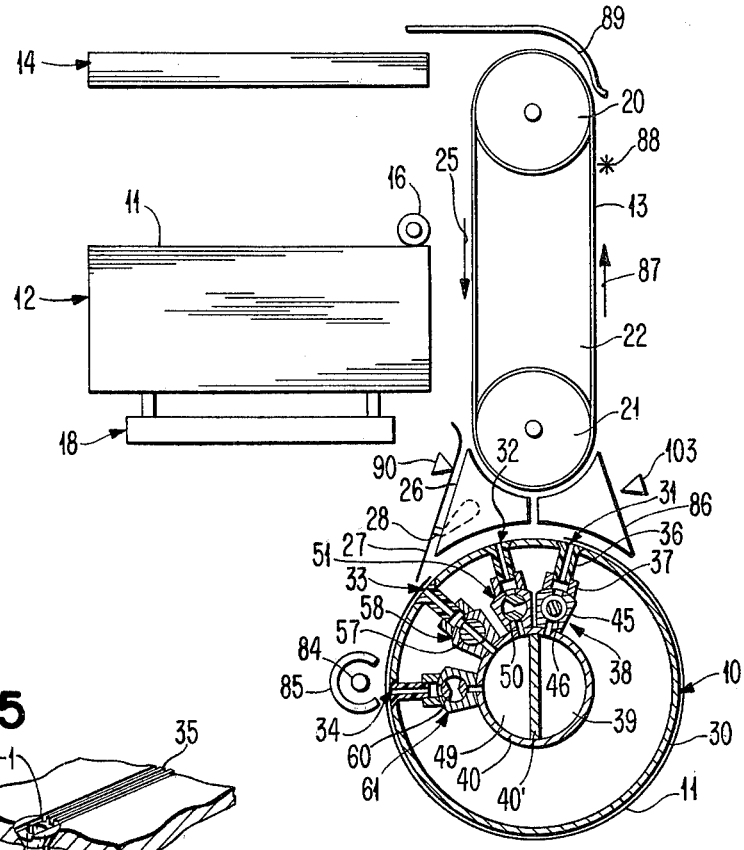
FIG. 1 is a schematic view of a sheet handling apparatus of the present invention.

Referring to the drawings and particularly FIG. 1, there is shown a low inertia rotary drum 10 to which single sheets 11 of flexible material such as paper, for example, are fed from a storage bin 12 by a plurality of conveying belts 13, which are arranged as shown and described in the aforesaid Korte application. After processing, each of the sheets 11 is fed from the drum 10 by the same conveying belts 13 to an output bin 14.

The individual sheets 11 are fed from the storage bin 12 by any suitable conventional feed mechanism such as a drive or feed roller 16, for example. The sheets 11 are individually fed outwardly from the storage bin 12 directly toward the belts 13. The sheets 11 may be biased upwardly against the drive roller 16 by a motor driven elevator 18.

The conveying belts 13 are mounted on a driving roll 20 and an idler roll 21. A vacuum plenum 22 is formed interior of the belts 13 between the rolls 20 and 21 to hold each of the sheets 11 against the belts 13. The vacuum plenum 22 is connected to a source of vacuum as more particularly shown and described in the aforesaid Korte application.

The sheets 11 are fed from the storage bin 12 by the drive or feed roller 16 in a direction substantially perpendicular to the belts 13 and towards the belts 13. The driving roll 20 drives the belt 13 in the direction of an arrow 25.

As the edge of each of the sheets 11 contacts the belts 13, the motion of the belts 13 in the direction of the arrow 25 causes the sheet 11 to be deflected downwardly and to gradually change its direction 90° and come into full contact with the belts 13. Each of the sheets 11 is held against the belts 13 by the vacuum from the vacuum plenum 22.

Guides 26 and 27 are located between the idler roll 21 and the drum 10. As the belts 13 advance the sheet 11 to the idler roll 21, the sheet 11 tends to continue in its original direction because there is no vacuum within the idler roll 21. Thus, the sheet 11 enters a slot formed between the guides 26 and 27. The guides 26 and 27 change the direction of the sheet 11 so that it moves outwardly in a direction tangential to the circumference of the drum 10.

The guide 26 has a solenoid operated mechanical gate 28 to prevent any of the sheets 11 from proceeding toward the drum 10 when the gate 28 is moved to a blocking position as shown in FIG. 1. When the gate 28 is rotated out of the slot between the guides 26 and 27, the belts 13 drive one of the sheets 11 between the guides 26 and 27 and into contact with the drum 10.

Figure 3:
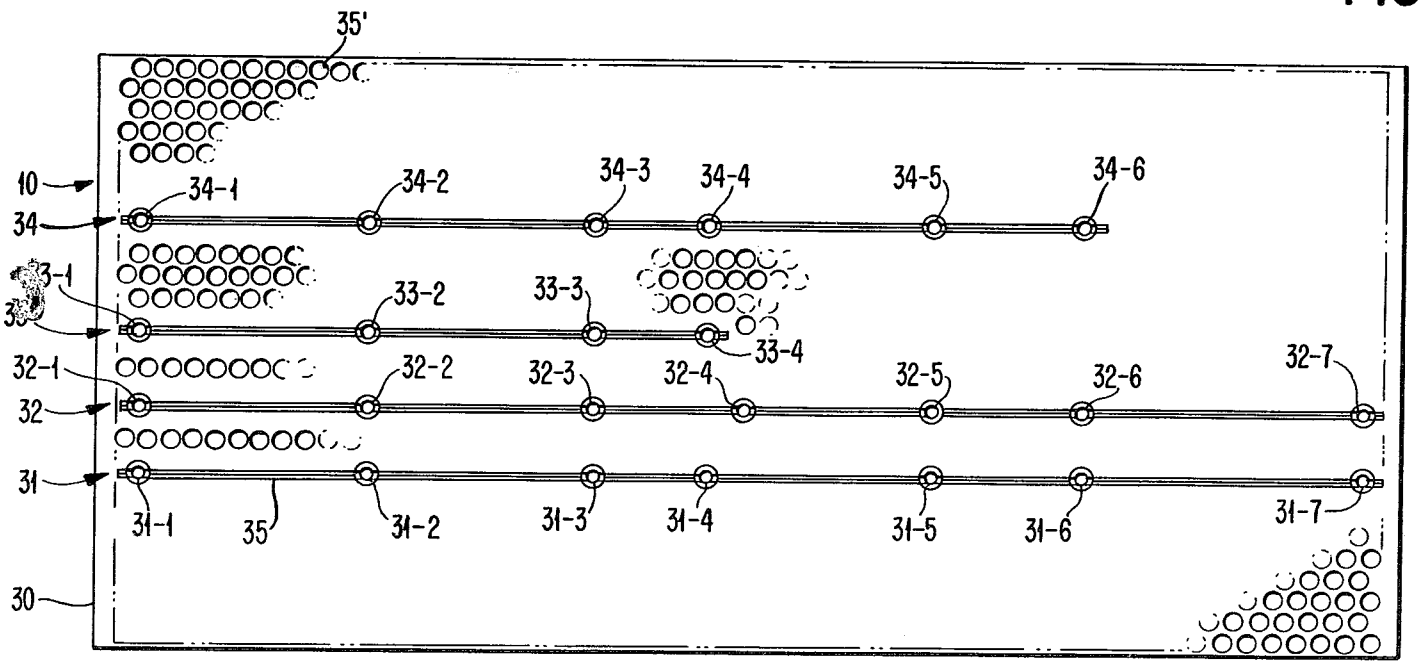
FIG. 3 is a schematic layout of the various ports in the rotary drum and showing their relationship to each other.
Figure 4:
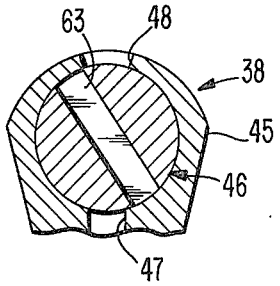
FIG. 4 is a sectional view of one portion of rotary valve means used with one of the leading edge ports in the rotary drum.
Figure 5:
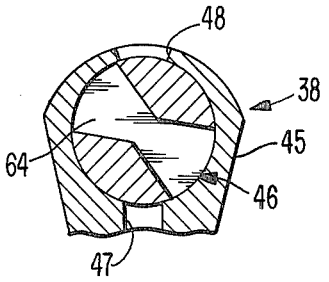
FIG. 5 is a sectional view of another portion of the rotary valve means used with another of the leading edge ports in the rotary drum.
Figure 6:
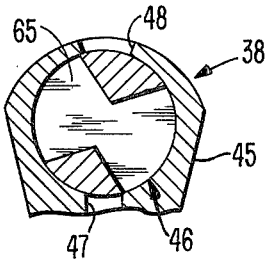
FIG. 6 is a sectional view of a further portion of the rotary valve means used with a third of the leading edge ports in the rotary drum.
Figure 7:
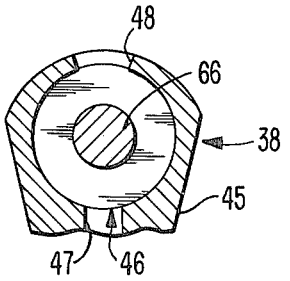
FIG. 7 is a sectional view of still another portion of the rotary valve means used with the remainder of the leading edge ports in the rotary drum.

The drum 10 includes an outer cylindrical shell or body 30 having a first set 31 of ports 31-1 (see FIG. 3), 31-2, 31-3, 31-4, 31-5, 31-6, and 31-7 formed in its surface and extending through the shell or body 30. The ports 31-1 to 31-7 extend longitudinally along the length of the shell 30 of the drum 10.

A second set 32 of ports 32-1, 32-2, 32-3, 32-4, 32-5, 32-6, and 32-7 is formed in the surface of the shell 30 at a selected arcuate distance around the shell 30 from the first set 31 and extends through the shell 30. The ports 32-1 to 32-7 extend longitudinally along the length of the shell 30 of the drum and have the same spacing between adjacent ports as the ports 31-1 to 31-7 except for the location of the port 32-4.

A third set 33 of ports 33-1, 33-2, 33-3, and 33-4 is formed in the surface of the shell 30 and extends through the shell or body 30. The third set 33 is arcuately spaced a selected distance from the first set 31. The ports 33-1 to 33-4 of the set 33 extend longitudinally along the length of the shell 30 of the drum 10 but only for the same distance as the ports 31-1 to 31-4 of the set 31 and with the same longitudinal spacing.

A fourth set 34 of ports 34-1, 34-2, 34-3, 34-4, 34-5, and 34-6 is formed in the surface of the shell 30 and extends through the shell 30. The fourth set 34 of the ports 34-1 to 34-6 is arcuately spaced a selected distance from the first set 31 of the ports 31-1 to 31-6. The ports 34-1 to 34-6 extend longitudinally along the length of the shell 30 of the drum 10 for the same distance as the ports 31-1 to 31-6 of the set 31, and the ports 32-1 to 32-6 of the set 32 have the same longitudinal spacing as the ports 31-1 to 31-6 of the set 31.

The ports 31-1 to 31-7 of the set 31 have communication along the surface of the shell 30 through slots 35 in the surface of the shell 30. The slots 35 enable the vacuum to be applied to the sheet 11 between each adjacent pair of the ports 31-1 to 31-7. Each of the sets 32, 33, and 34 has its ports similarly connected.

The ports 31-1, 32-1, 33-1, and 34-1 are closest to the end of the shell 30 over which the sheet 11 always passes irrespective of the dimension of the sheet 11 because of a fixed reference guide (not shown) for one edge of the sheet 11. The center of each of the ports 31-1, 32-1, 33-1, and 34-1 is approximately 0.625" from the end of the drum 10 so that these ports are adjacent the leading edge of the sheet 11.

The centers of the ports 31-2, 31-3, 31-4, 31-5, 31-6, and 31-7 are spaced 3", 6", 7.5", 10.5", 12.5", and 16.5", respectively, from the center of the port 31-1. The ports of each of the sets 32, 33, and 34 with the same suffixes are similarly spaced as the ports 31-2 to 31-7 having the same suffix except that the center of the port 32-4 is disposed 8" from the center of the port 32-1. This is because the set 32 handles only 8½" paper and not 8" paper.

The shell or body 30 is formed with a plurality of openings 35' therein. The openings 35' in the shell 30 significantly reduce the inertia of the shell 30.

Figure 15:
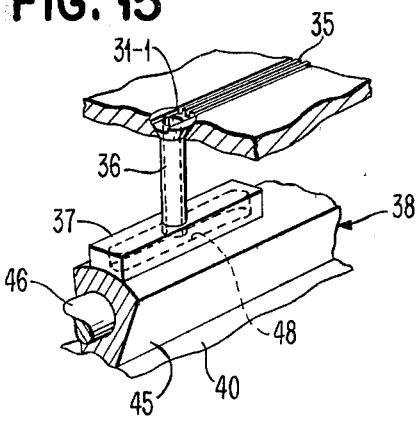
FIG. 15 is a perspective view, partly in section, showing the connection between a port and rotary valve means.

Each of the ports 31-1 to 31-7 of the set 31 is connected through a tube 36 (see FIGS. 1 and 15), a manifold 37, and rotary valve means 38 to a leading edge chamber 39, which is formed within a portion of a shell or body 40 by a divider 40' and has a vacuum selectively supplied thereto. The shell or body 40 is secured by a pair of end plates 41 (see FIG. 2) and 42 (see FIG. 12) to the shell 30 to form the drum 10.

A spindle or shaft 43 (see FIG. 2) is secured to the end plate 41 and driven in a manner such as that shown and described in the aforesaid Korte application. A spindle or shaft 44 (see FIG. 12) is secured to the end plate 42 so that the drum 10 is rotatably supported.

The rotary valve means 38 includes a hollow longitudinal body 45 (see FIGS. 1 and 2), which is secured to the end plate 42 (see FIG. 12) and extends within the shell 30. The body 45 terminates prior to the end plate 41 (see FIG. 2) and has a rotary valve 46 rotatably disposed therein. The rotary valve 46 is rotatably supported by the end plates 41 and 42 (see FIG. 12).

Figure 2:
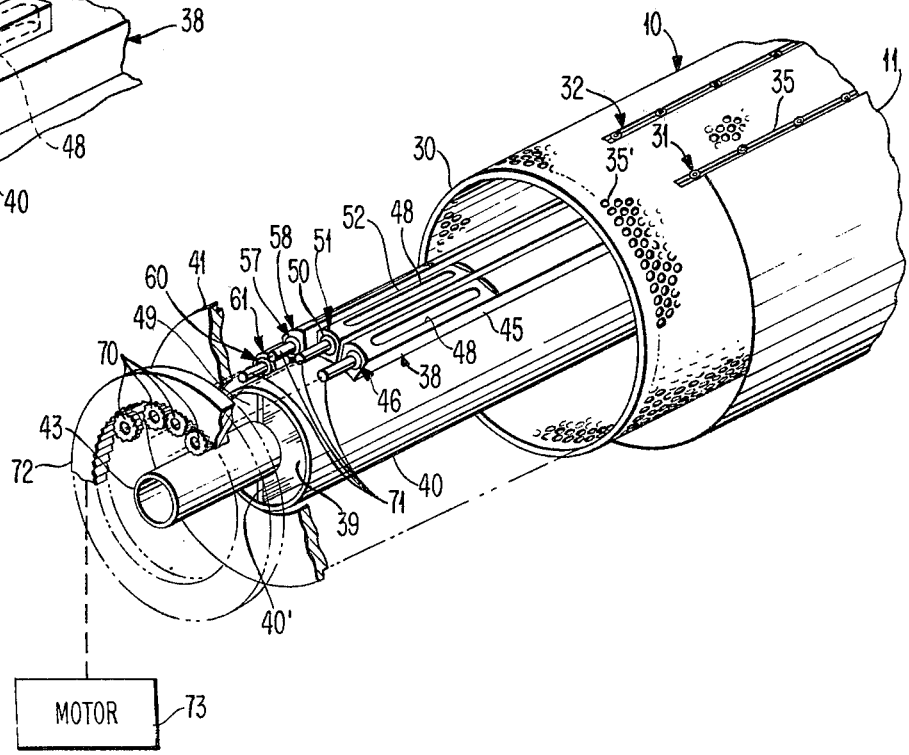
FIG. 2 is a schematic perspective view of a portion of a rotary drum of the sheet handling apparatus of FIG. 1 with some parts omitted for clarity purposes.

The body 45 (see FIGS. 4–7) has a plurality of longitudinal openings 47, which are equal in number to the seven ports 31-1 to 31-7 (see FIG. 3) in the set 31, communicating with the leading edge chamber 39 (see FIGS. 1 and 2). The body 45 (see FIGS. 4–7) has seven longitudinal openings 48, which are equal to the seven openings 47, with each of the openings 48 being disposed substantially diametrically opposite to one of the openings 47. Each of the openings 48 communicates with one of the manifolds 37 (see FIG. 15).

The rotary valve 46 (see FIGS. 4–7) is a cylindrical body, which is formed with a plurality of passage means extending therethrough for controlling the communication of each of the openings 47 with the diametrically disposed opening 48. Thus, when the rotary valve 46 does not have passage means providing communication between the openings 47 and 48 for a rotary position of the rotary valve 46, no vacuum can be applied to the port communicating with the opening 48 in the body 45. Therefore, the rotary position of the rotary valve 46 controls the portion of the surface of the shell 30 (see FIGS. 1 and 2) to which the vacuum from the leading edge chamber 39 is applied.

The rotary valve 46 has the passage means formed therein in accordance with when the connecting port of the ports 31-1 to 31-7 (see FIG. 3) is to have the vacuum applied thereto. This depends upon the dimension of the sheet 11 (see FIG. 2) in the longitudinal direction of the shell 30.

The ports 32-1 to 32-7 (see FIG. 3) of the set 32 communicate with a trailing edge vacuum chamber 49 (see FIGS. 1 and 2), which also is within the shell 40 and separated from the leading edge chamber 39 by the divider 40', in accordance with the rotary position of a rotary valve 50 of rotary valve means 51. The rotary valve means 51 includes a hollow longitudinal body 52, which is secured to the end plate 42 (see FIG. 12) and extends within the shell 30, having the rotary valve 50 rotatably disposed therein. The rotary valve 50 (see FIG. 2) is rotatably supported by the end plates 41 and 42 (see FIG. 12).

Figure 8:
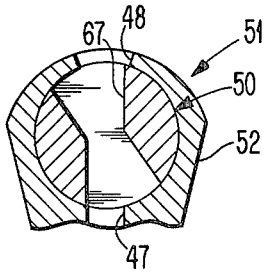
FIG. 8 is a sectional view of a portion of rotary valve means used with some of the ports of one set of the trailing edge ports in the rotary drum.

The remainder of the structure of the rotary valve means 51 (see FIG. 8) is the same as the rotary valve means 38 (see FIGS. 4–7) except that the body 52 (see FIG. 8) has each of the openings 47 communicating with the trailing edge vacuum chamber 49 (see FIGS. 1 and 2) rather than the leading edge chamber 39. Some of the passage means in the rotary valve 50 are different than the passage means in the rotary valve 46.

Figure 9:
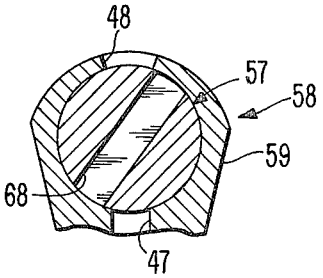
FIG. 9 is a sectional view of a portion of rotary valve means used with some of the ports of another set of the trailing edge ports in the rotary drum.

A rotary valve 57 of rotary valve means 58 controls communication of each of the ports 33-1 to 33-4 (see FIG. 3) of the set 33 with the trailing edge vacuum chamber 49 (see FIGS. 1 and 2). The rotary valve means 58 (see FIG. 9) includes a hollow longitudinal body 59, which is secured to the end plate 42 (see FIG. 12) and extends within the shell 30, having the rotary valve 57 (see FIG. 2) rotatably disposed therein. The rotary valve 57 is rotatably supported by the end plates 41 and 42 (see FIG. 12).

The rotary valve means 58 (see FIG. 2) is similar to the rotary valve means 51 except that the rotary valve 57 does not have the same passage means extending therethrough. This is because the rotary valve 57 controls the communication of each of the ports 33-1 to 33-4 (see FIG. 3) of the set 33 with the trailing edge vacuum chamber 49 (see FIGS. 1 and 2), and these have a vacuum applied at a different time than the ports 32-1 to 32-7 (see FIG. 3) of the set 32 because the ports 32-1 to 32-7 of the set 32 are never used when the ports 33-1 to 33-4 of the set 33 are being employed and vice versa.

Figure 10:
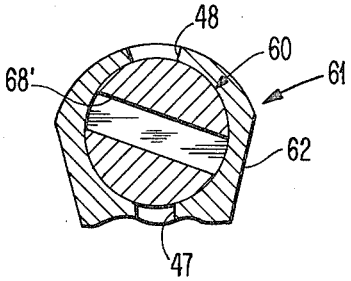
FIG. 10 is a sectional view of one portion of rotary valve means used with one port of a further set of the trailing edge ports in the rotary drum.
Figure 11:
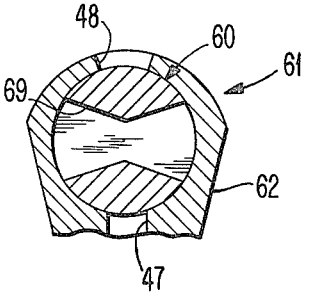
FIG. 11 is a sectional view of another portion of the rotary valve means used with other ports of the further set of the trailing edge ports in the rotary drum.

A rotary valve 60 (see FIGS. 1 and 2) of rotary valve means 61 controls communication between each of the ports 34-1 to 34-6 (see FIG. 3) of the set 34 and the trailing edge vacuum chamber 49 (see FIGS. 1 and 2). The rotary valve means 61 includes a hollow longitudinal body 62 (see FIGS. 10 and 11), which is secured to the end plate 42 (see FIG. 12) and extends within the shell 30, having the rotary valve 60 (see FIGS. 1 and 2) rotatably disposed therein. The rotary valve 60 is rotatably supported by the end plates 41 and 42 (see FIG. 12).

The rotary valve means 61 (see FIGS. 1 and 2) is the same as each of the rotary valve means 51 and 58 except that the passage means in the rotary valve 60 are different than the passage means in the rotary valve 50 of the rotary valve means 51 and the passage means in the rotary valve 57 of the rotary valve means 58. This is because the rotary valve 60 controls the application of vacuum for each of the ports 34-1 to 34-6 (see FIG. 3), and this occurs only when there is no vacuum being applied to any of the ports 32-1 to 32-7 of the set 32 or to any of the ports 33-1 to 33-4 of the set 33.

Figure 13:
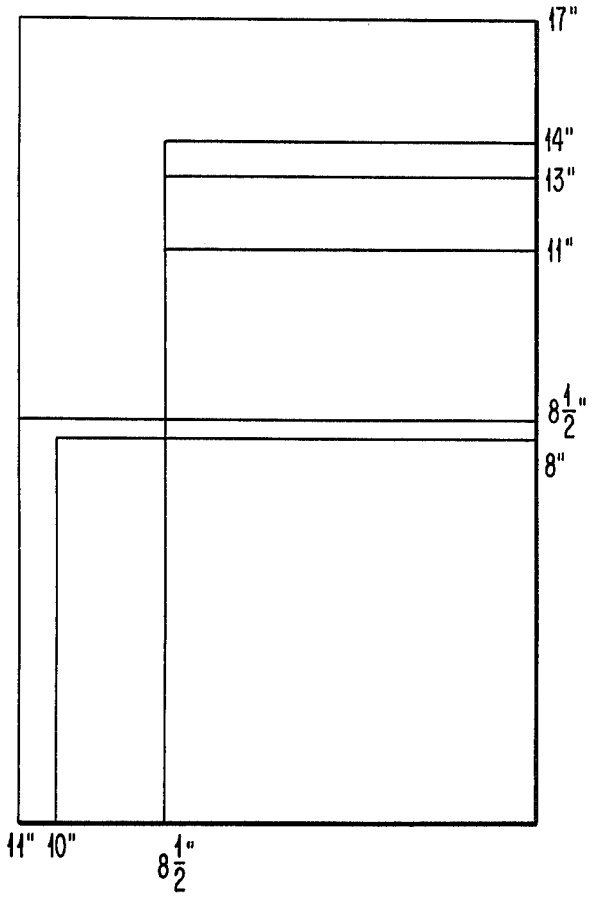
FIG. 13 is a schematic diagram showing the various sizes of sheets handled by the apparatus of the present invention.

Referring to FIG. 13, the layout of the sheet 11 for different dimensions is shown. Thus, in the longitudinal direction of the shell 30, the sheet 11 can have dimensions of 8", 8½", 11", 13", 14", and 17" with the dimensions of the sheet 11 around the shell 30 being 8½", 10", and 11". Therefore, the shell 30 can accommodate the sheet 11 when it is 11"×8½", 11"×17", 8½"×13", 8½"×14", 8½"×11", and 10"×8".

If each of the rotary valves 46 (see FIG. 2), 50, 57, and 60 is simultaneously rotated in 36" increments, a maximum of five different passages can be provided through each of the rotary valves 46, 50, 57, and 60. With one of the passages being deemed to be at 0° (Of course, one end of the passage would be at 0° and the other at 180°.), the other passages would be disposed at 36°, 72°, 108°, and 144°.

The following table shows which of the ports of each of the sets 31-34 (The ports are identified by only the suffix.) are open to supply a vacuum (indicated by O), closed to not supply a vacuum (indicated by C), or not formed (X) for each of the five positions to which the rotary valves 46, 50, 57, and 60 are simultaneously rotated. Whenever one of these ports is to be open, the controlling rotary valve must provide the passage.

PORT SEQUENCE TABLE

PAPER SIZE 11 × 8½ (ROTARY VALVES AT 0°)

| | PORTS | | | | | | |
|---|---|---|---|---|---|---|---|
| | 1 | 2 | 3 | 4 | 5 | 6 | 7 |
| SETS | | | | | | | |
| 31 | O | O | O | O | C | C | C |
| 32 | O | O | O | O | C | C | C |
| 33 | C | C | C | C | X | X | X |
| 34 | C | C | C | C | C | C | X |

PAPER SIZE 11 × 17 (ROTARY VALVES AT 36°)

| | PORTS | | | | | | |
|---|---|---|---|---|---|---|---|
| | 1 | 2 | 3 | 4 | 5 | 6 | 7 |
| SETS | | | | | | | |
| 31 | O | O | O | O | O | O | O |
| 32 | O | O | O | O | O | O | O |
| 33 | C | C | C | C | X | X | X |
| 34 | C | C | C | C | C | C | X |

PAPER SIZE 8½ × 13 OR 14 (ROTARY VALVES AT 72°)

PORTS

-continued

| | 1 | 2 | 3 | 4 | 5 | 6 | 7 |
|---|---|---|---|---|---|---|---|
| SETS | | | | | | | |
| 31 | O | O | O | O | O | O | C |
| 32 | C | C | C | C | C | C | C |
| 33 | C | C | C | C | X | X | X |
| 34 | O | O | O | O | O | O | X |
| PAPER SIZE 8½ × 11 (ROTARY VALVES AT 108°) | | | | | | | |
| | PORTS | | | | | | |
| | 1 | 2 | 3 | 4 | 5 | 6 | 7 |
| SETS | | | | | | | |
| 31 | O | O | O | O | O | C | C |
| 32 | C | C | C | C | C | C | C |
| 33 | C | C | C | C | X | X | X |
| 34 | O | O | O | O | O | C | X |
| PAPER SIZE 10 × 8 (ROTARY VALVES AT 144°) | | | | | | | |
| | PORTS | | | | | | |
| | 1 | 2 | 3 | 4 | 5 | 6 | 7 |
| SETS | | | | | | | |
| 31 | O | O | O | O | C | C | C |
| 32 | C | C | C | C | C | C | C |
| 33 | O | O | O | O | X | X | X |
| 34 | C | C | C | C | C | C | X |

As shown in the table, the port 31-7 of the set 31 is open only when the rotary valve 46 is at the 36° position. Therefore, the rotary valve 46 has a passage 63 (see FIG. 4) extending therethrough to provide communication from the opening 47 in the body 45 to the diametrically disposed opening 48 in the body 45 only when the rotary valve 46 is at a 36° position. The body of the rotary valve 46 blocks communication between the openings 47 and 48 in the body 45 whenever the rotary valve 46 is at any of the 0°, 72°, 108°, and 144° positions.

The rotary valve 46 has a passage 64 (see FIG. 5) therein to provide communication from the leading edge chamber 39 (see FIGS. 1 and 2) to the port 31-6 (see FIG. 3) of the set 31 when the rotary valve 46 (see FIG. 5) is at each of the 36° and 72° positions. The body of the rotary valve 46 blocks communication between the openings 47 and 48 which cooperate with the passage 64 whenever the rotary valve 46 is at any of the 0°, 108°, and 144° positions.

The rotary valve 46 has a passage 65 (see FIG. 6) to provide communication of the leading edge chamber 39 (see FIGS. 1 and 2) with the port 31-5 (see FIG. 3) of the set 31. The passage 65 (see FIG. 5) provides communication when the rotary valve 46 is at the 36°, 72°, or 108° position. At the 0° and 144° positions of the rotary valve 46, the port 31-5 (see FIG. 3) of the set 31 does not communicate with the leading edge chamber 39 (see FIGS. 1 and 2).

Figure 14:
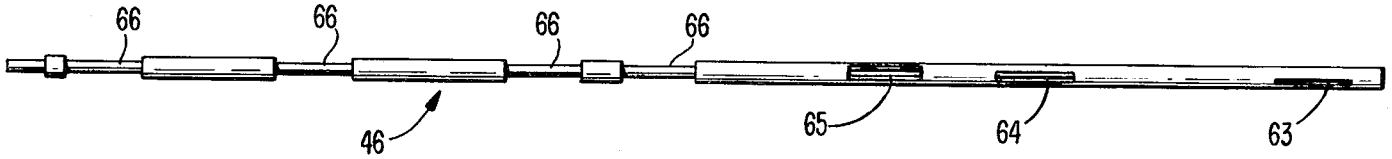
FIG. 14 is a plan view of the rotary valve of the rotary valve means used with the leading edge ports.

The rotary valve 46 has reduced portions 66 (see FIGS. 7 and 14) to provide continuous communication of each of the ports 31-1 (see FIG. 3), 31-2, 31-3, and 31-4 with the leading edge chamber 39 (see FIGS. 1 and 2) since the vacuum is continuously applied through these four ports as indicated in the table. That is, these four ports 31-1 to 31-4 (see FIG. 3) always are utilized irrespective of the dimension of the sheet 11 (see FIG. 2).

The rotary valve 50 has a passage extending therethrough of the same type as the passage 63 (see FIG. 4) in the rotary valve 46 for each of the passages communicating with the ports 32-5 (see FIG. 3), 32-6, and 32-7 of the set 32. Thus, the ports 32-5, 32-6, and 32-7 of the set 32 have a vacuum applied thereto from the trailing edge vacuum chamber 49 (see FIGS. 1 and 2) only when the rotary valve 50 is in the 36° position.

The rotary valve 50 has a passage 67 (see FIG. 8) extending therethrough at each of four spaced longitudinal positions similar to the longitudinal positions of the reduced portions 66 (see FIG. 14) of the rotary valve 46 to provide communication from the trailing edge vacuum chamber 49 (see FIGS. 1 and 2) to each of the ports 32-1 (see FIG. 3), 32-2, 32-3, and 32-4. The passages 67 (see FIG. 8) provide communication only when the rotary valve 50 is at the 0° or 36° position.

Thus, as shown in the table, all of the ports 31-1 to 31-7 (see FIG. 3) of the set 31 and all of the ports 32-1 to 32-7 of the set 32 are in communication with the leading edge chamber 39 (see FIGS. 1 and 2) and the trailing edge vacuum chamber 49, respectively, when the rotary valves 46 and 50 are at the 36° position. When the rotary valves 46 and 50 are at the 0° position, then only the ports 31-1 to 31-4 (see FIG. 3) of the set 31 and the ports 32-1 to 32-4 of the set 32 communicate with the leading edge chamber 39 (see FIGS. 1 and 2) and the trailing edge vacuum chamber 49, respectively.

The rotary valve 57 has a passage 68 (see FIG. 9) extending therethrough at each of the same longitudinal positions as the reduced portions 66 (see FIG. 14) of the rotary valve 46 to provide communication between the ports 33-1 to 33-4 (see FIG. 3) of the set 33 (These are the only ports of the set 33.) with the trailing edge vacuum chamber 49 (see FIGS. 1 and 2). The passages 68 (see FIG. 9) provide communication between each of the ports 33-1 to 33-4 (see FIG. 3) and the trailing edge vacuum chamber 49 (see FIGS. 1 and 2) only when the rotary valve 57 is at the 144° position.

The rotary valve 60 has a passage 68' (see FIG. 10) to provide communication from the port 34-6 (see FIG. 3) to the trailing edge vacuum chamber 49 (see FIGS. 1 and 2) only when the rotary valve 60 is at the 72° position. The rotary valve 60 has a passage 69 (see FIG. 11) extending therethrough at each of the same longitudinal positions as the reduced portions 66 (see FIG. 14) and the passage 65 of the rotary valve 46 to provide communication between each of the ports 34-1 to 34-5 (see FIG. 3) of the set 34 and the trailing edge vacuum chamber 49 (see FIGS. 1 and 2) when the rotary valve 60 is at the 72° or 108° position.

Each of the rotary valves 46, 50, 57, and 60 has a gear 70 (see FIG. 2) mounted on the end of a spindle 71, which rotatably supports the connected rotary valve in the end plate 41, extending from one end thereof. The gears 70 mesh with a central gear 72, which is driven by a motor 73 through a clutch.

The motor 73 rotates each of the rotary valves 46, 50, 57, and 60 through 36° during each energization of the motor 73. Thus, all of the rotary valves 46, 50, 57, and 60 are simultaneously rotated through 36° increments so that all of the rotary valves 46, 50, 57, and 60 are at the same position (0°, 36°, 72°, 108°, or 144°) at the same time.

The central gear 72 must be prevented from rotating after the rotary valves 46, 50, 57, and 60 have been rotated to their desired rotary position so that the rotary valves 46, 50, 57, and 60 will remain in the desired position during any rotation of the drum 10. Therefore, it is necessary to have a detent (not shown) to lock the central gear 72 to the shell 30 to prevent any relative movement between the central gear 72 and the shell 30 when the drum 10 is rotated. It is desired that the motor 73 be disconnected from the central gear 72 at this time.

Accordingly, when the sheet 11 has a size of 11"×17", the rotary valves 46, 50, 57, and 60 are positioned at their 36° position. As shown in the table, this causes all of the ports 31-1 to 31-7 of the set 31 to communicate with the leading edge chamber 39 and all of the ports 32-1 to 32-7 of the set 32 to communicate with the trailing edge vacuum chamber 49. The sheet 11 of 11"×17" is disposed so that its 17" dimension is along the length of the shell 30 and its 11" dimension is around the shell 30 as shown in FIG. 13. The table shows the other various sizes of the sheet 11 and which of the ports 31-1 to 31-7 of the set 31 is communicating with the chamber 39 depending upon the position of the rotary valve 46 and which of the ports of one of the sets 32-34 is communicating with the chamber 49 depending upon the position of the rotary valves 50, 57, and 60.

Figure 12:
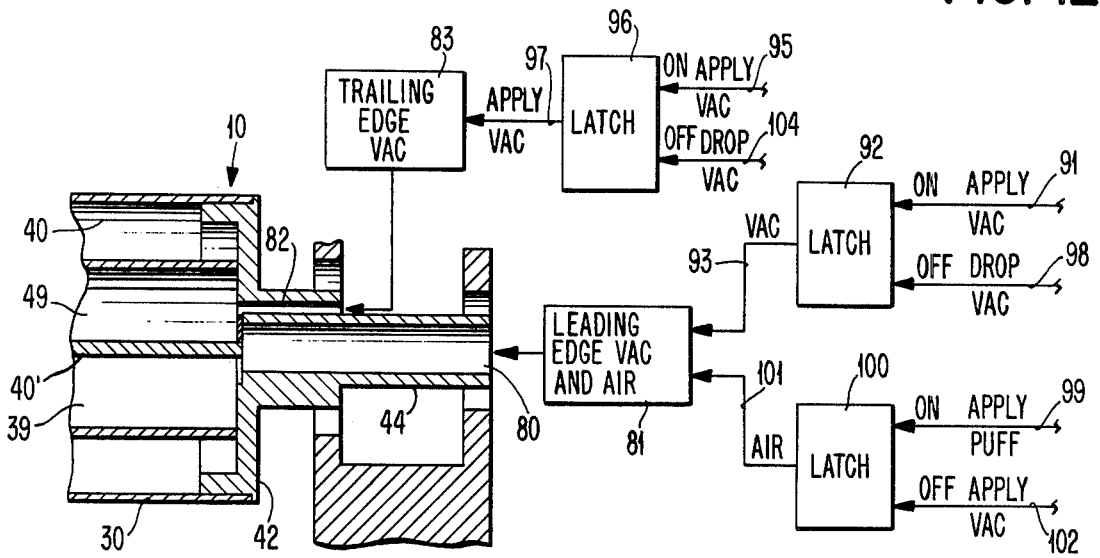
FIG. 12 is a schematic sectional view of a portion of the drum and schematically showing the supply of vacuum and pressure.

As shown in FIG. 12, the spindle 44 has a port 80 extending therethrough and communicating with the leading edge chamber 39 and with a leading edge vacuum and air source 81. Thus, the leading edge chamber 39 can have either a vacuum or air pressure therein.

The spindle 44 has a port 82 therein communicating with the trailing edge vacuum chamber 49 and with a trailing edge vacuum source 83. As more particularly shown and described in the aforesaid Korte application, the ports 80 and 82 are separated from each other.

Timing of the opening of the gate 28 (see FIG. 1) is such that the leading edge of the sheet 11 contacts the drum 10 to overlie some or all of the ports 31-1 to 31-7 (see FIG. 3) of the set 31. The vacuum from the leading edge vacuum and air source 81 (see FIG. 12) is applied to one or more of the ports 31-1 to 31-7 (see FIG. 3) of the set 31 in accordance with the dimension of the sheet 11 (see FIG. 2) along the length of the shell 30 to attract and hold the leading edge of the sheet 11 to the drum 10.

As the drum 10 rotates counterclockwise (as viewed in FIG. 1), the sheet 11 is drawn from the slot or guide path formed by the guides 26 and 27. The belts 13 are operated at a slightly lower velocity than the surface velocity of the drum 10 to prevent buckling of the sheet 11 during loading and to keep it taut.

The drum 10 is coated with a dielectric so that at least the surface contacting the sheet 11 is non-conductive. An activated ionizing corona wire 84 with a shield 85 ionizes the surrounding air and directs the ions toward the drum 10 to cause the surface of the drum 10 to become charged.

As the insulated sheet 11 is interposed between the corona wire 84 and the drum 11, the sheet 11 is charged on the side facing the corona wire 84 at the same polarity as the drum 10. Thus, the side of the sheet 11 facing the drum 10 is charged at the opposite polarity so that it is attracted to the drum 10.

As the drum rotates, the sheet 11 is wrapped around the drum 10 with the trailing edge of the sheet 11 overlying at least one of the sets 32-34 of the ports. The dimension of the sheet 11 in the arcuate direction around the shell 30 determines how many of the sets 32-34 of the ports have the sheet 11 overlying them.

In accordance with the dimension of the sheet 11 in the arcuate direction around the shell 30 of the drum 10, some or all of the ports of one of the sets 32-34 has a vacuum applied thereto from the trailing edge vacuum source 83 (see FIG. 12). The table discloses which of the ports of which of the sets 32-34 (see FIG. 1) are communicating with the trailing edge vacuum chamber 49 for a specific dimension of the sheet 11. The application of the vacuum to some or all of the ports of one of the sets 32-34 holds the trailing edge of the sheet 11 tightly against the drum 10.

Accordingly, the sheet 11 is tightly fixed to the drum 10 at the leading and trailing edges of the sheet 11 by the applied vacuums and the intermediate portions of the sheet 11 are attracted to the drum 10 by means of the applied static charge. Then, the drum 10 may rotate one or many times with the sheet 11 attached to the drum 10 to process the sheet 11 such as by printing thereon, for example.

The drum 10 is driven in two different modes in the manner more particularly shown and described in the aforesaid Korte application. One of these modes is to load and unload the sheets 11 on the drum 10 and the other mode is to rotate the drum 10 at a much higher velocity for processing.

A guide 86 (see FIG. 1) is located between the drum 10 and the idler roll 21. As the leading edge of the sheet 11 approaches the guide 86 after completion of processing, the vacuum from the leading edge vacuum and air source 81 (see FIG. 12) is shut off and pressurized air is supplied from the leading edge vacuum and air source 81 to the leading edge chamber 39 (see FIGS. 1 and 2). The chamber 39 communicates with four or more of the ports 31-1 to 31-7 (see FIG. 3) of the set 31 in accordance with the dimension of the sheet 11 (see FIG. 1) along the length of the shell 30, as shown by the table, so that the pressurized air is supplied through these ports to lift the leading edge of the sheet 11 from the drum 10.

As the leading edge of the sheet 11 is raised from the surface of the drum 10 by this puff of pressurized air, the leading edge of the sheet 11 contacts the guide 86, which strips the sheet 11 from the drum 10 and guides it into contact with the belts 13. The electrostatic force continues to hold the remainder of the sheet 11 on the drum 10 as the sheet 11 is stripped off by the guide 86.

The vacuum plenum 22 draws the sheet 11 into firm contact with the belts 13 for transport by the belts 13 in the direction indicated by an arrow 87. As the sheet 11 is drawn upwardly, it passes one or more discharge electrodes 88, which are connected to electrical ground so as to discharge the static electrical charges from the sheet 11.

As the sheet 11 reaches the driving roll 20, the vacuum from the vacuum plenum 22 is not applied to the sheet 11 so that the sheet 11 continues in the direction of the arrow 87. The sheet 11 strikes a guide 89 so that the sheet 11, which has been processed, is turned 90° towards the output bin 14 in which it is deposited.

As more particularly shown and described in the aforesaid Korte application, the drive or feed roller 16 supplies one of the sheets 11 to be conveyed by the belts 13 in the direction of the arrow 25 to the gate 28. A new sheet sensor 90 detects the presence of one of the sheets 11 at the gate 28 and prevents further operation of the drive or feed roller 16 until the sheet 11 has been fed past the opened gate 28.

As more particularly shown and described in the aforesaid Korte application, a signal is supplied over an input 91 (see FIG. 12) of a latch 92 to provide a signal on a line 93 to the leading edge vacuum and air source 81. This signal on the line 93 causes the leading edge vacuum and air source 81 to supply a vacuum through the port 80 to the leading edge chamber 39. The signal can be applied to the leading edge vacuum and air source 81 only when the sensor 90 (see FIG. 1) has indicated that one of the sheets 11 is positioned at the gate 28.

As more particularly shown and described in the aforesaid Korte application, the gate 28 is opened by a solenoid after the sensor 90 has indicated the presence of one of the sheets 11 at the gate 28. Thus, the sheet 11 is fed towards the drum 10 in a precise relationship with the rotary portion of the drum 10 so that the vacuum is being applied to some or all of the ports 31-1 to 31-7 (see FIG. 3) of the set 31 when the leading edge of the sheet 11 (see FIG. 1) contacts the drum 10 so that the sheet 11 is held in place by the vacuum in the leading edge chamber 39 (see FIGS. 2 and 12).

The continued rotation of the drum 10 (see FIG. 1) pulls the sheet 11 from the guides 26 and 27 to cause the sheet 11 to wrap around the drum 10. During this pulling of the sheet 11 from the guides 26 and 27, the ionization from the corona wire 84 creates a charge on the sheet 11 to hold the sheet 11 against the drum 10.

As more particularly shown and described in the aforesaid Korte application, a signal is supplied to an input 95 (see FIG. 12) of a latch 96 at a specific time after the gate 28 (see FIG. 1) was opened. The signal on the input 95 (see FIG. 12) causes the latch 96 to supply a signal on a line 97 whereby the trailing edge vacuum source 83 creates a vacuum in the trailing edge vacuum chamber 49.

The rotary positions of the rotary valves 50 (see FIG. 2), 57, and 60 determine which set of the sets 32 (see FIG. 3), 33, and 34 of the ports is communicating with the trailing edge vacuum chamber 49 (see FIG. 12) to enable vacuum to be applied to a portion of the surface of the shell 30 of the drum 10. The application of the vacuum through some or all of the ports of one of the sets 32-34 (see FIG. 3), depending on the dimension of the sheet 11 (see FIG. 1), draws in and holds the trailing edge of the sheet 11 against the drum 10.

Thereafter, as shown and described in the aforesaid Korte application, the velocity of the drum 10 is increased and processing occurs. After processing, the drum 10 is decelerated to its lower velocity.

Then, as more particularly shown and described in the aforesaid Korte application, a signal is supplied on an input 98 (see FIG. 12) of the latch 92 to turn off the latch 92. This terminates the signal from the latch 92 on the line 93 to the leading edge vacuum and air source 81 whereby the vacuum from the leading edge vacuum and air source 81 is stopped.

Next, as more particularly shown and described in the aforesaid Korte application, a signal is supplied to an input 99 of a latch 100. This causes the latch 100 to produce a signal on a line 101 to the leading edge vacuum and air source 81. As a result, the leading edge vacuum and air source 81 supplies air under pressure through the port 80 to the leading edge chamber 39 and through some or all of the ports 31-1 to 31-7 (see FIG. 3) of the set 31 in accordance with the position of the rotary valve 46 (see FIG. 2) to lift the leading edge of the processed sheet 11 (see FIG. 1) from the surface of the drum 10.

As the leading edge of the sheet 11 is raised from the surface of the drum 10, the guide 86 intercepts the leading edge of the sheet 11 and strips it from the drum 10 as the drum 10 rotates. Electrostatic charge holds the sheet 11 to the drum 10 as the stripping occurs to keep the sheet 11 from flying off the drum 10.

As more particularly shown and described in the aforesaid Korte application, a signal is next supplied over an input 102 (see FIG. 12) of the latch 100 and the input 91 of the latch 92. The signal on the input 102 turns off the latch 100, and the signal on the input 91 turns on the latch 92. The presence of a signal on the line 93 and the absence of a signal on the line 101 causes the leading edge vacuum and air source 81 to switch from supplying air pressure to the port 80 to applying a vacuum thereto. With the leading edge vacuum and air source 81 applying a vacuum, another of the sheets 11 (see FIG. 1) may be gated onto the drum 10 past the gate 28.

A sensor 103 is operated to detect the presence of the sheet 11 on the guide 86. As more particularly shown and described in the aforesaid Korte application, the failure of the sensor 103 to detect the presence of a sheet 11 on the guide 86 indicates a failure with various possible failure modes being initiated.

If there is no failure indicated by the sensor 103 because the sheet 11 is on the guide 86, a signal is supplied to an input 104 (see FIG. 12) of the latch 96 as more particularly shown and described in the aforesaid Korte application. This signal on the input 104 causes the latch 96 to turn on to discontinue the signal on the line 97. As a result, the trailing edge vacuum source 83 no longer applies a vacuum to the trailing edge vacuum chamber 49 so that the trailing edge of the sheet 11 (see FIG. 1) is not held against the drum 10. Freeing of the trailing edge of the sheet 11 from the drum 10 allows the sheet 11 to be drawn away from the drum 10 by the belts 13.

As more particularly shown and described in the aforesaid Korte application, another cycle of loading the sheet 11 on the drum 10, processing of the sheet 11 on the drum 10, and removing the sheet 11 from the drum 10 begins when the sensor 90 indicates that another of the sheets 11 is at the gate 28 and that the leading edge of the previous sheet 11 was detached from the drum 10 as determined by the sensor 103 sensing the sheet 11 on the guide 86. These cycles will continue until another of the sheets 11 is no longer available at the gate 28. When this occurs, the system will be idle until a start switch is again operated as more particularly shown and described in the aforesaid Korte application.

Considering the operation of the present invention, it is first necessary to position the drum 10 to a reference position to keep track of where the rotary valves 46, 50, 57, and 60 are in relation to the 0° position. Then, the motor 73 (see FIG. 2) can be activated to drive the central gear 72 to rotate each of the rotary valves 46, 50, 57, and 60 to one of the five rotary positions (0°, 36°, 72°, 108°, and 144°) in accordance with the dimensions of the sheet 11. This positioning of the rotary valves 46, 50, 57, and 60 insures that the vacuum is applied to the portions of the sheet 11 and not to the ambient.

After the motor 73 has been inactivated to stop the rotary valves 46, 50, 57, and 60 at one of the five rotary positions, the central gear 72 and the gears 71 are locked against any motion by the detent (not shown). This insures that the rotary valves 46, 50, 57, and 60 remain in the desired position during any rotation of the drum 10.

Then, feeding of the sheet 11 by the drive roller 16 from the storage bin 12 can occur. This causes one of the sheets 11 to be held by the gate 28 between the guides 26 and 27.

Thereafter, the gate 28 ceases to block the sheet 11 when the drum 10 is at a specific rotary position whereby the leading edge of the sheet 11 will fall over some or all of the ports 31-1 to 31-7 (see FIG. 3) of the set 31.

Then, the sheet 11 (see FIG. 1) is ionized as it passes the corona wire 84. Next, a vacuum is applied to the trailing edge vacuum chamber 49 at the desired time interval for the specific dimensions of the sheet 11. That is, the vacuum is applied to the trailing edge vacuum chamber 49 (see FIGS. 2 and 12) at the time that the ports of the selected set of the sets 32-34 (see FIG. 3) has the trailing edge of the sheet 11 (see FIG. 1) arriving. This is a timed sequence in accordance with the velocity of the drum 10 and the arcuate distance of the specific set of the sets 32-34 (see FIG. 3) of ports from the set 31.

After the sheet 11 (see FIG. 1) is on the drum 10, the velocity of the drum 10 is increased for processing. After the processing is completed and the velocity of the drum 10 is decreased, the application of a vacuum to the leading edge chamber 39 (see FIGS. 2 and 12) is stopped and pressurized air is supplied thereto to cause the leading edge of the sheet 11 (see FIG. 1) to be raised from the surface of the drum 10 and the guide 86 to intercept it to strip the sheet 11 from the drum 10 as the drum 10 rotates.

The vacuum is removed from the trailing edge vacuum chamber 49 (see FIGS. 2 and 12) at a time to enable easy removal of the trailing edge of the sheet 11 (see FIG. 1) from the drum 10 by the guide 86. Another cycle begins when the rotary drum 10 has the ports 31-1 to 31-7 (see FIG. 3) of the set 31 ready to receive the leading edge of the next sheet 11 (see FIG. 1) even though the trailing edge of the processed sheet 11 is still on the drum 10.

While the present invention has shown and described rotary valves to control the application of a vacuum to various portions of the surface of the drum 10, it should be understood that any other suitable valve means could be employed. For example, sliding valve means could be utilized rather than the rotary valve means.

An advantage of this invention is that it enables different size sheets of flexible material to be handled by a vacuum drum. Another advantage of this invention is that it eliminates the need for separate baffles, rotating seals, and solenoid valves for each size paper with a vacuum drum.

While the invention has been particularly shown and described with reference to a preferred embodiment thereof, it will be understood by those skilled in the art that various changes in form and details may be made therein without departing from the spirit and scope of the invention.

What is claimed is:

1. An apparatus for transporting rectangular shaped, flexible sheets of various sizes including:

transporting means having a surface for transporting the sheet;

first vacuum means for attaching the leading portion of the sheet to said surface of said transporting means by applying a first controlled vacuum to a varying selected portion of said surface of said transporting means, said first vacuum means including means to control the varying selected portion of said surface of said transporting means to which said first vacuum means applies the first controlled vacuum in accordance with one of the dimensions of the sheet;

second vacuum means for attaching the trailing portion of the sheet to said surface of said transporting means by applying a second controlled vacuum, controlled separately from the first controlled vacuum applied by said first vacuum means, to a varying selected portion of said surface of said transporting means, said second vacuum means including means to control the varying selected portion of said surface of said transporting means to which said second vacuum means applies the second controlled vacuum in accordance with both of the dimensions of the sheet;

said second vacuum means including means to apply the second controlled vacuum to said surface of said transporting means at each of a plurality of selected distances from the application of the first controlled vacuum by said first vacuum means;

and said control means of said second vacuum means including means to control the second controlled vacuum for selective application by said applying means of said second vacuum means to said surface of said transporting means at each of the selected distances from where said first vacuum means applies the first controlled vacuum by allowing said applying means of said second vacuum means to apply the second controlled vacuum at only one of the selected distances at any time while preventing said applying means of said second vacuum means for applying the second controlled vacuum at each of the other of the selected distances at the same time in accordance with the other of the dimensions of the sheet and along the portion of said surface of said transporting means at the one selected distance in accordance with the one dimension of the sheet.

2. The apparatus according to claim 1 including ionization means for electrostatically charging the sheet to hold the sheet to said surface of said transporting means.

3. The apparatus according to claim 2 in which said transporting means is a rotary drum.

4. An apparatus for transporting rectangular shaped, flexible sheets of various sizes including:

transporting means having a surface for transporting the sheet;

first vacuum means for attaching the leading portion of the sheet to said surface of said transporting means by applying a first controlled vacuum to a varying selected portion of said surface of said transporting means, said first vacuum means including means to control the varying selected portion of said surface of said transporting means to which said first vacuum means applies the first controlled vacuum in accordance with one of the dimensions of the sheet;

second vacuum means for attaching the trailing portion of the sheet to said surface of said transporting means by applying a second controlled vacuum, controlled separately from the first controlled vacuum applied by said first vacuum means, to a varying selected portion of said surface of said transporting means, said second vacuum means including means to control the varying selected portion of said surface of said transporting means to which said second vacuum means applies the second controlled vacuum in accordance with at least the one dimension of the sheet;

said second vacuum means including:

vacuum producing means to produce the second controlled vacuum;

and means connecting said vacuum producing means of said second vacuum means with said surface of said transporting means at at least one selected distance from where said first vacuum means applies the first controlled vacuum to said surface of said transporting means;

said control means of said second vacuum means including means to control the varying selected portion of said surface of said transporting means with which said connecting means of said second vacuum means connects said vacuum producing means in accordance with the one dimension of the sheet;

said first vacuum means including:

vacuum producing means, separate from said vacuum producing means of said second vacuum means, to produce the first controlled vacuum;

and means connecting said vacuum producing means of said first vacuum means with said surface of said transporting means;

and said control means of said first vacuum means including means to control the varying selected portion of said surface of said transporting means with which said connecting means of said first vacuum means connects said vacuum producing means of said first vacuum means.

5. An apparatus for transporting rectangular shaped, flexible sheets of various sizes including:

transporting means having a surface for transporting the sheet;

first vacuum means for attaching the leading portion of the sheet to said surface of said transporting means by applying a first controlled vacuum to a varying selected portion of said surface of said transporting means, said first vacuum means including means to control the varying selected portion of said surface of said transporting means to which said first vacuum means applies the first controlled vacuum in accordance with one of the dimensions of the sheet;

second vacuum means for attaching the trailing portion of the sheet to said surface of said transporting means by applying a second controlled vacuum, controlled separately from the first controlled vacuum applied by said first vacuum means, to a varying selected portion of said surface of said transporting means, said second vacuum means including means to control the varying selected portion of said surface of said transporting means to which said second vacuum means applies the second controlled vacuum in accordance with at least the one dimension of the sheet;

said second vacuum means including:

vacuum producing means to produce the second controlled vacuum;

and means connecting said vacuum producing means of said second vacuum means with said surface of said transporting means at a plurality of selected distances from where said first vacuum means applies the first controlled vacuum to said surface of said transporting means with the selected distances being in the direction of the other of the dimensions of the sheet;

and said control means of said second vacuum means including means to control the varying selected portion of said surface of said transporting means with which said controlling means of said second vacuum means connects said vacuum producing means in accordance with both the one dimension of the sheet and the selected distance with the selected distance being in accordance with the other of the dimensions of the sheet so that the second controlled vacuum is applied at only one of the selected distances at any time while the application of the second controlled vacuum at each of the other of the selected distances is prevented.

6. The apparatus according to claim 5 in which:

said first vacuum means includes:

vacuum producing means, separate from said vacuum producing means of said second vacuum means, to produce the first controlled vacuum;

and means connecting said vacuum producing means of said first vacuum means with said surface of said transporting means;

and said control means of said first vacuum means includes means to control the varying selected portion of said surface of said transporting means with which said connecting means of said first vacuum means connects said vacuum producing means of said first vacuum means.

7. An apparatus for supporting rectangular shaped, flexible sheets of various sizes thereon including:

a rotary drum to receive a sheet for support thereby;

first vacuum producing means to produce a first controlled vacuum;

second vacuum producing means, separate from said first vacuum producing means, to produce a second controlled vacuum;

said drum having a plurality of sets of ports in its outer surface, each of said sets of said ports being spaced arcuately about said drum with respect to the remainder of said sets of said ports, each of said sets of said ports having said ports spaced from each other longitudinally of said drum;

first connecting means in said drum to connect one of said sets of said ports only to said first vacuum producing means;

a plurality of second connecting means, equal in number to the number of the remainder of said sets of said ports, in said drum to connect each of the remainder of said sets of said ports only to said second vacuum producing means;

said first connecting means having first control means to control communication of said first vacuum producing means with each of said ports of said one set to control which of said ports of said one set receives the first controlled vacuum;

each of said second connecting means having second control means to control communication of said second vacuum producing means with each of said ports of said remaining set of said ports to which said second connecting means is connected;

and third control means to cause said first control means to be positioned in accordance with one of the dimensions of the sheet and to cause only one of said second control means to allow communication of the second controlled vacuum at any time through only one of said second connecting means with at least one of said ports of said remaining set of said ports to which said second connecting means is connected in accordance with both of the dimensions of the sheet.

8. The apparatus according to claim 7 in which said first control means and each of said second control means comprises valve means.

9. An apparatus for supporting rectangular shaped, flexible sheets of various sizes thereon including:

a rotary drum to receive a sheet for support thereby;

first vacuum producing means;

second vacuum producing means;

said drum having a plurality of sets of ports in its outer surface, each of said sets of said ports being spaced arcuately about said drum with respect to the remainder of said sets of said ports, each of said sets of said ports having said ports spaced from each other longitudinally of said drum;

first means in said drum to connect one of said sets of said ports to said first vacuum producing means;

second means, equal in number to the number of the remainder of said sets of said ports, in said drum to connect each of the remainder of said sets of said ports to said second vacuum producing means;

said first means having first control means to control communication of said first vacuum producing means with each of said ports of said one set;

each of said second means having second control means to control communication of said second vacuum producing means with each of said ports of said remaining set of said ports to which said second means is connected;

third control means to cause said first control means to be positioned in accordance with one of the dimensions of the sheet and to cause only one of said second control means to allow communication through said second means in accordance with both of the dimensions of the sheet;

said first control means and each of said second control means comprises valve means;

said valve means of said first control means including a body having at least first, second, and third passage means extending therethrough at spaced longitudinal distances of said body, said first passage means providing communication of said first vacuum producing means with only a portion of said ports of said one set of said ports when said valve means is in a first position, said first and second passage means providing communication of said first vacuum producing means with more of said ports of said one set of said ports than said first passage means but less than all of said ports when said valve means is in a second position, and said first, second, and third passage means providing communication of said first vacuum producing means with all of said ports of said one set of said ports when said valve means is in a third position;

a first of said valve means of said second control means including a body having at least first and second passage means extending therethrough at spaced longitudinal distances of said body, said first passage means providing communication of said second vacuum producing means with only a portion of said ports of a first of said remaining sets of said ports with which said second means having said first valve means communicates when said first valve means is in a first position, the number of said ports being the same as the number of said ports with which said first passage means of said valve means of said first control means provides communication, said first and second passage means providing communication of said second vacuum producing means with all of said ports of said first remaining set of said ports with which said second means having said first valve means communicates when said first valve means is in a second position with the number of ports being equal to the number of ports in said one set of said ports;

a second of said valve means of said second control means including a body having passage means providing communication of said second vacuum producing means with all of said ports of a second of said remaining sets of said ports with which said second means having said second valve means communicates when said second valve means is in a first position, the number of said ports of said second set of said remaining sets of said ports being less than the number of said ports of said first set of said remaining sets of said ports;

and said third control means including means to move said valve means of said first control means to its first position and said first valve means of said second control means to its first position at the same time, to move said valve means of said first control means to its second position and said second valve means of said second control means to its first position at the same time, and to move said valve means of said first control means to its third position and said first valve means of said second control means to its second position at the same time.

10. The apparatus according to claim 9 in which:

said first vacuum producing means includes a first vacuum chamber in said drum;

and said second vacuum producing means includes a second vacuum chamber in said drum.

11. The apparatus according to claim 10 in which each of said valve means comprises a rotary valve.

12. The apparatus according to claim 9 in which each of said valve means comprises a rotary valve.

13. An apparatus for supporting rectangular shaped, flexible sheets of various sizes thereon including:

a rotary drum to receive a sheet for support thereby;

first vacuum producing means;

second vacuum producing means;

said drum having a plurality of sets of ports in its outer surface, each of said sets of said ports being spaced arcuately about said drum with respect to the remainder of said sets of said ports, each of said sets of said ports having said ports spaced from each other longitudinally of said drum;

first means in said drum to connect one of said sets of said ports to said first vacuum producing means;

second means, equal in number to the number of the remainder of said sets of said ports, in said drum to connect each of the remainder of said sets of said ports to said second vacuum producing means;

said first means having first control means to control communication of said first vacuum producing means with each of said ports of said one set;

each of said second means having second control means to control communication of said second vacuum producing means with each of said ports of said remaining set of said ports to which said second means is connected;

third control means to cause said first control means to be positioned in accordance with one of the dimensions of the sheet and to cause only one of said second control means to allow communication through said second means in accordance with both of the dimensions of the sheet;

said first control means and each of said second control means comprises valve means;

and said valve means of said first control means including a body having at least first and second passage means extending therethrough at spaced longitudinal distances of said body, said first passage means providing communication of said first vacuum producing means with only a portion of said ports of said one set of said ports when said valve means of said first control means is in a first position and said first and second passage means providing communication of said first vacuum producing means with all of said ports of said one set of said ports when said valve means of said first control means is in a second position.

14. The apparatus according to claim 13 in which one of said valve means of said second control means includes a body having at least first and second passage means extending therethrough at spaced longitudinal distances of said body, said first passage means providing communication of said second vacuum producing means with only a portion of said ports of one of said remaining sets of said ports with which said second means having said valve means communicates when said valve means is in a first position and said first and second passage means providing communication of said second vacuum producing means with all of said ports of said one remaining set of said ports with which said second means having said valve means communicates when said valve means is in a second position.

15. The apparatus according to claim 14 in which each of said valve means comprises a rotary valve.

16. An apparatus for supporting rectangular shaped, flexible sheets of various sizes thereon including:

a rotary drum to receive a sheet for support thereby;

first vacuum producing means;

second vacuum producing means;

said drum having a plurality of sets of ports in its outer surface, each of said sets of said ports being spaced arcuately about said drum with respect to the remainder of said sets of said ports, each of said sets of said ports having said ports spaced from each other longitudinally of said drum;

first means in said drum to connect one of said sets of said ports to said first vacuum producing means;

second means, equal in number to the number of the remainder of said sets of said ports, in said drum to connect each of the remainder of said sets of said ports to said second vacuum producing means;

said first means having first control means to control communication of said first vacuum producing means with each of said ports of said one set;

each of said second means having second control means to control communication of said second vacuum producing means with each of said ports of said remaining set of said ports to which said second means is connected;

third control means to cause said first control means to be positioned in accordance with one of the dimensions of the sheet and to cause only one of said second control means to allow communication through said second means in accordance with both of the dimensions of the sheet;

said first control means and each of said second control means comprises valve means;

and each of said valve means comprising a rotary valve.

17. The apparatus according to claim 4 in which each of said control means of said first vacuum means and said control means of said second vacuum means comprises a rotary valve.

18. An apparatus for supporting rectangular shaped, flexible sheets of various sizes thereon including:

transporting means having a surface for transporting the sheet;

a first vacuum chamber having a first controlled vacuum;

a second vaccum chamber having a second controlled vacuum;

first connecting means to continuously connect said first vacuum chamber to a first area of said surface of said transporting means for attaching the leading portion of the sheet to said surface of said transporting means;

first control means to selectively control the portion of the first area of said surface of said transporting means to which the first controlled vacuum from said first vacuum chamber is applied through said first connecting means in accordance with one of the dimensions of the sheet;

second connecting means to continuously connect said second vacuum chamber to at least one other area of said surface of said transporting means spaced from the first area of said surface of said transporting means in the direction of the other of the dimensions of the sheet;

and second control means to selectively control the portion of the other area of said surface of said transporting means to which the second controlled vacuum from said second vacuum chamber is applied through said second connecting means for attaching the trailing portion of the sheet to said surface of said transporting means in accordance with at least the one dimension of the sheet.

19. The apparatus according to claim 18 in which said second control means selectively controls the portion of the other area of said surface of said transporting means to which the second controlled vacuum from said second vacuum chamber is applied in accordance with both of the dimensions of the sheet.

20. The apparatus according to claim 19 including:

a plurality of second connecting means to continuously connect said second vacuum chamber to a plurality of spaced areas of said surface of said transporting means spaced from each other and from the first area of said surface of said transporting means in the direction of the other dimension of the sheet;

and separate second control means for each of said second connecting means to selectively control said second connecting means so that the second controlled vacuum from said second vacuum chamber is applied through only one of said second connecting means at any time to only one of said spaced areas in accordance with the other dimension of the sheet and to the portion of said one spaced area in accordance with the one dimension of the sheet.

21. The apparatus according to claim 20 in which said first control means and each of said separate control means is a rotary valve.

22. The apparatus according to claim 21 in which said transporting means is a rotary drum.

* * * * *

UNITED STATES PATENT AND TRADEMARK OFFICE

CERTIFICATE OF CORRECTION

PATENT NO. : 4,202,542

DATED : May 13, 1980

INVENTOR(S) : G. B. Lammers et al.

It is certified that error appears in the above-identified patent and that said Letters Patent are hereby corrected as shown below:

Column 6, line 35, change "36"" to --36°--.
Column 9, line 49, change "drum 11" to --drum 10--.
line 54, after "drum", insert --10--.

Signed and Sealed this

*Twenty-eighth* Day of *October 1980*

[SEAL]

*Attest:*

SIDNEY A. DIAMOND

*Attesting Officer*

*Commissioner of Patents and Trademarl*